US005415904A

United States Patent [19]

Takubo et al.

[11] Patent Number: 5,415,904

[45] Date of Patent: May 16, 1995

[54] SNAP FASTENER AND PACKAGING BAG WITH THE SAME

[75] Inventors: Toyokazu Takubo; Shigezo Yamamoto, both of Himeji, Japan

[73] Assignee: Idemitsu Petrochemical Co., Ltd., Tokyo, Japan

[21] Appl. No.: 49,003

[22] Filed: Apr. 16, 1993

[30] Foreign Application Priority Data

Apr. 17, 1992 [JP] Japan ..... 4-097918

[51] Int. Cl.[6] ..... B65D 33/25

[52] U.S. Cl. ..... 428/35.2; 428/200; 428/349; 428/476.1; 428/516; 383/63; 383/65; 383/93; 493/214; 24/580

[58] Field of Search ..... 428/35.2, 475.8, 476.1, 428/516, 200, 500, 99, 349; 383/63, 65, 93; 24/580, 584; 493/214

[56] References Cited

U.S. PATENT DOCUMENTS

| | | | |
|---|---|---|---|
| 4,421,805 | 12/1983 | Prader | 428/35.2 |
| 4,687,688 | 8/1987 | Curie et al. | 428/476.1 |
| 4,691,372 | 9/1987 | Van Erden | 383/63 |
| 4,756,629 | 7/1988 | Tilman et al. | 383/63 |
| 4,859,513 | 8/1989 | Gibbons et al. | 428/476.1 |
| 4,997,710 | 3/1991 | Pockat et al. | 428/476.1 |

FOREIGN PATENT DOCUMENTS

| | | |
|---|---|---|
| 0339324 | 11/1989 | European Pat. Off. . |
| 0371402 | 6/1990 | European Pat. Off. . |
| 2120999 | 12/1983 | United Kingdom . |

*Primary Examiner*—Ellis P. Robinson
*Assistant Examiner*—Rena L. Dye
*Attorney, Agent, or Firm*—Flynn, Thiel, Boutell & Tanis

[57] ABSTRACT

A snap fastener (11) having a base section (14), (17) to be welded to a bag body (22) is made of a linear chain low-density polyethylene (L-LDPE) or a compound resin of the linear chain low-density polyethylene and a low-density polyethylene (LDPE) as a sub-ingredient. A packaging bag is fabricated with the snap fastener from the bag body (22) and the pair of snap fastener half-members. When the snap fastener (11) is made of a compound resin of L-LDPE and LDPE, the composition ratio between them is set at 95–60 wt %:5–40 wt %. The melt index (MI) of the compound resin is set at a range of 1–15 g/10 minutes. The packaging bag body (22) is adapted to have an inner side layer made of L-LDPE. An outer side layer adhered to the inner side layer may be made of nylon so as to form the multilayered bag body.

12 Claims, 2 Drawing Sheets

SNAP FASTENER AND PACKAGING BAG WITH THE SAME

BACKGROUND OF THE INVENTION

1. Field of the Invention

This invention relates to a snap fastener and a packaging bag having the snap fastener and, more particularly, is available in several fields such as the food industry, pharmaceutical preparations, and haberdashery.

2. Description of the Related Art

Several packaging bags which have, on an opening side thereof, a web-like snap fastener consisting of a male snap fastener half-member (herein after referred to as "male half-member") and a corresponding female snap fastener half-member (herein after referred to as "female half-member") capable of intermeshing each other so that the opening side of the packaging bag can be shut and opened repeatedly, have been used in the food industry, pharmaceutical preparations, and haberdashery. It is noted that there have been some proposed methods of producing such a packaging bag.

One of the known general methods to produce the packaging bag is to extrude a cylindrical film with the male half-member as well as the corresponding female half-member through an extruding die and the other is to preliminary produce a two-piece type snap fastener tape of which one is used as the male half-member and the other is used as the corresponding female half-member and to adhere/weld the tape on a base film as the packaging bag body by means of a thermal adhesion method or an adhesive agent.

The former method involves some problems such that there is a limit in variety of applicable resins, it is inapplicable to laminated films, it can not be adapted to needed sizes of the packaging bag, and it can not be printed on easily, so that this method is restricted to produce general-purpose packaging bag. As the latter method has some advantages in applications to various size bags, dealings and costs because the packaging bag can be produced by a combination with the tape with snap fastener and the base film, this method is more popular than the former method.

The materials for the snap fastener are preferably low-density polyethylene (LDPE), polypropylene (PP) or the like so that the snap fastener can be adhered to the base film made from the same resin. Therefore, if an outer layer of the base film where the snap fastener is attached is made from LDPE, the snap fastener should be produced from LDPE, too.

However, the snap fastener made from LDPE or PP tends to not obtain enough adhesion to the bag body at a low heating temperature. When the packaging bag with the snap fastener made from LDPE is sterilized by boiling, some problems to be avoided will take place.

Accordingly, it is an object of the present invention to provide a preferable snap fastener and packaging bag with the same, in which a reliable adhesion at a low temperature and a greater heat-resistance can be obtained.

SUMMARY OF THE INVENTION

A snap fastener according to the present invention is characterized in having a welding portion to be welded to an object to be provided with the snap faster, the welding portion of said snap fastener being made of a linear chain low-density polyethylene.

The welding portion of the snap fastener may be made of a compound resin of the linear chain low-density polyethylene (L-LDPE) and a low-density polyethylene (LDPE) as a sub-ingredient. The compound resin of the linear chain low-density polyethylene and the low-density polyethylene is set in a ratio of 95–60 wt %:5–40 wt %.

The resin forming the welding portion has a melt index (MI) of from 1–15 g/10 minutes, preferably from 2–8 g/10 minutes. The MI beyond this range causes a poor shape of the snap fastener after boiling so that the performance of open-and-close becomes bad.

The recommended thickness of the welding portion is 80–220 micrometers, preferably 130–170 micrometers because the hot-welding temperature tends to fall upon a decrease of the thickness of the welding portion.

A method of producing the snap fastener is not limited particularly into a certain one but can be conducted by being molded by means of a corresponding die and cooling the molded article in water.

An original shape of the snap fastener according to the present invention needs not to be limited into one shape with a pair of half-members intermeshing each other but also can be any known shape capable of intermeshing with each other.

A packaging bag capable of opening-and-closing repeatedly according to the present invention is characterized by having: a bag body fabricated at three end portions thereof; and a snap fastener having a welding portion to be welded to one end portion except the three end portions of the bag body, the welding portion of said snap fastener being made of a linear chain low-density polyethylene. The welding portion of the snap fastener may be made of a compound resin of the linear chain low-density polyethylene and a low-density polyethylene as a sub-ingredient.

Incidentally, the hot-welding between the snap fastener and the bag body can be conducted by means of heat, high-frequency, ultrasonic waves energy, or the like.

The preferable resins for the inner side layer of the bag body are, for example, LDPE, ethylene-vinyl acetate copolymer (EVA), ethylene-methacrylic acid copolymer (EMAA), ionomer (IO), L-LDPE or the like. The most preferable material is L-LDPE considering thermal properties. The outer side layer contacting with the inner side layer is preferably Nylon, Polyethylene terephthalate (PET), PP, Biaxially oriented nylon finished with vinylidene chloride (KON) and Biaxially oriented polypropylene finished with vinylidene chloride (KOP), or the like. Furthermore, the snap fastener can be added thereon with a general compounding ingredient, if necessary. For instance, there is a coloring agent, stabilizing agent, anti-oxidizing agent, slipping agent, chemical destaticizer, or the like. The slipping agent, as one of the known compounding ingredients, should be added to the materials to produce the snap fastener in a amount of 0.05–0.5 wt % in order to obtain smooth intermeshing between the male half-member and the female half-member. As the slipping agents, there are an oleic acid amide, erucic acid amide, stearic acid amide, behenic acid amide, oleyl palmitamide, calcium stearate, talc, kaolin, silica, polysiloxane, and so on, but the oleic acid amide and the erucic acid amide are popular among them. When either the oleic acid amide or the erucic acid amide is used, the mentioned addition ratio should be maintained to obtain a preferable performance of open-and-close. As the anti-oxidizing agent, a phenolic, phosphorus, or sulfur type can be applied. As the chemical destaticizer, 0.05–0.5 wt %, preferably 0.1–0.2 wt %, of a compound consisting of the stearic acid monoglyceride and the palmitinic acid monoglyceride is preferable.

DETAILED DESCRIPTION OF THE PREFERRED EMBODIMENT(S)

The preferred embodiment of the present invention will now be described with reference to the drawings.

1ST EXPERIMENTAL EXAMPLE

Figure 1:
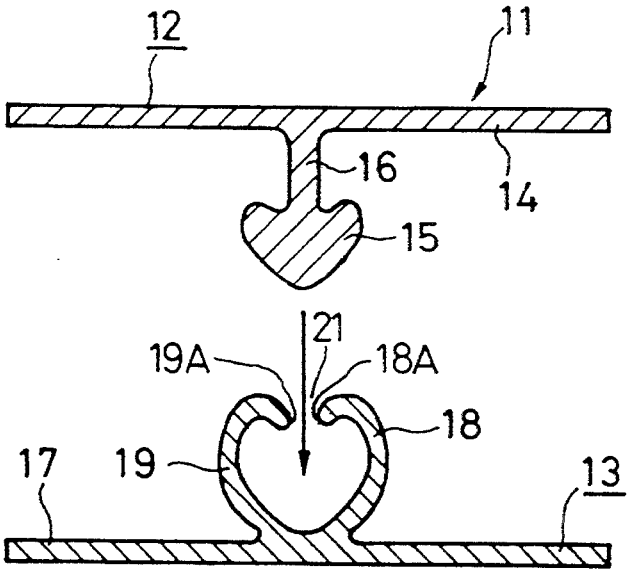
FIG. 1 is a sectional view of a pair of male and female half-members capable of intermeshing according to the first embodiment of the present invention.
Figure 2:
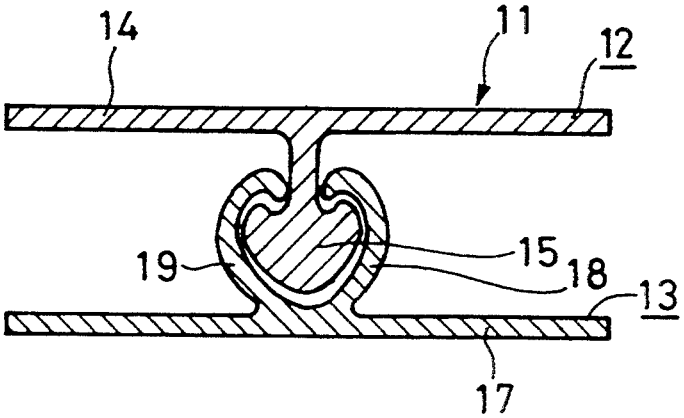
FIG. 2 is a sectional view of the snap fastener in an intermeshing state.

A pair of a male half-member 12 and a female half-member 13 formed into shapes as shown in FIGS. 1 and 2 according to the present invention can be manufactured from a linear chain low-density polyethylene (L-LDPE) as a feed stock, while extruding and cooling successively the L-LDPE through an extruder. Incidentally, the L-LDPE has a melt index; 6 g/10 minutes.

A snap fastener 11 in this experimental example can be fabricated with the male half-member 12 and the female half-member 13. The male half-member 12 is integrated with a web-like base section 14 as a welding portion to be welded to a bag body, a sectionally heart-shaped head section 15 and a joint section 16 to connect both sections 14 and 15 with each other.

The female half-member 13 is integrated with a web-like base section 17 to be welded to a bag body, a semi-circular first hook 18 fixed in relation to the base section 17 and a second hook symmetrical to the first hook 18. There is provided an interval 21 between edges 18A and 19A of both hooks 18 and 19. Incidentally, the base sections 14 and 17 have a thickness of 150 micrometers.

An intermeshing between the male and female half-members 12, 13 can be performed by closing both half-members 12, 13 to each other to hold the head portion 15 of the male half-member 12 at the intervals between the edges 18A and 19A of the female half-member 13 and continuously closing to each other while parting the hooks 18, 19 to right and left until the head section 15 will be completely located in a space between the hooks 18, 19.

Figure 3:
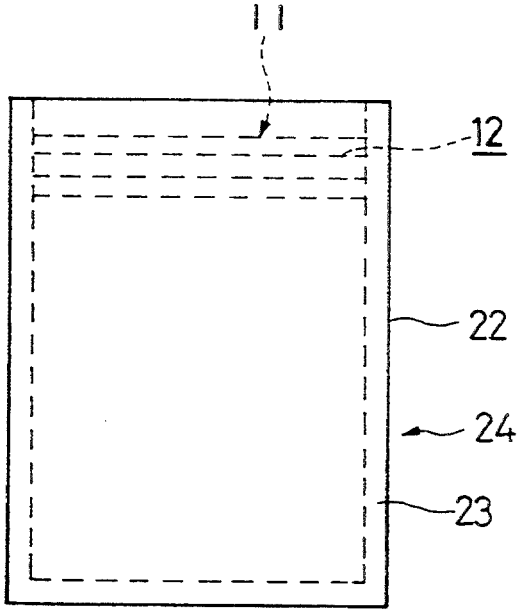
FIG. 3 is the front view of a packaging bag with the snap fastener according to the first embodiment.
Figure 4:
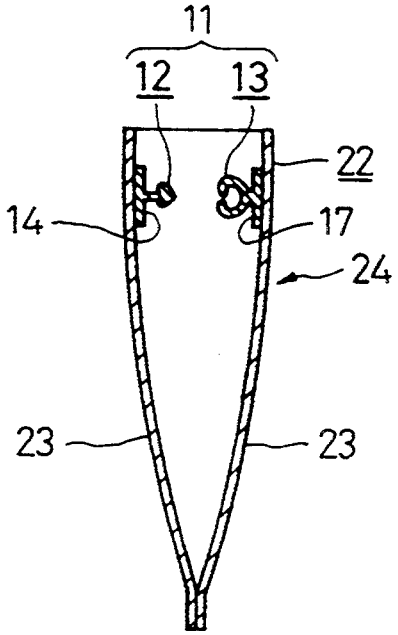
FIG. 4 is a sectional view of the packaging bag with the snap fastener depicted in FIG. 3.

FIGS. 3 and 4 are related drawings depicting a packaging bag 24 with the above-mentioned snap fastener 11 consisting of the male half-member 12 and the female half-member 13. The packaging bag 24 can be fabricated by heat-welding both base sections 14 and 17 of the male and female half-members 12 and 13 to a base film 23 forming a bag body 22 by means of a heat seal bar at a temperature of 143 degrees and further heat-sealing three sides of the bag body 22 except for an opening side where the snap faster 11 is lain.

The base film 23 has two layers; a nylon-6 layer (15 micrometers)/a L-LDPE layer (120 micrometers), wherein the L-LDPE layer is used as an inside layer of the bag body 22 and adapted to be heat-welded with the male half-member 12 or the female half-member 13.

The applicant conducted several experimental examples and control examples to confirm the thermal properties of the produced packaging bag with the snap fastener 24 under a boiling temperature of 90, 95 or 99 degrees for 45 minutes. Each result of the experimental examples and control examples is shown in Table 1. At the thermal properties evaluation column in this table, the legend "Circle" explains a state of the bag with no problem after boiling, the legend "Cross" explains a presence of tear and/or abnormal appearance in the bag after boiling so that a preferable performance of open-and-close on the opening side of the bag become worse. The presence of "Tear" means, when opening the packaging bag, a state to be able to realize a break on the bag where the heat seal bar acted to the base sections 14, 17 so as to heat-weld the base sections 14, 17 and the inside layer of the bag body 22. The "Abnormal appearance" means a malfunction of the snap fastener 11 because of its thermal deformation, or a state that the packaging bag looks unattractive because of creases thereon which is caused by the heat contraction gap between those of the snap fastener 11 and the base film 23. Furthermore, at a column for the evaluation on shape retainment of the snap fastener in Table 1, the legend "Double-circle" explains a preferable shape of the both half-members, the legend "Circle" explains a state that unfavorable deformation of the half-members can be seen, but can be still put to practical use, and the legend "Cross" explains a state that the deformation of both half-members is too big to intermesh with each other. However, it should be noted, in Table 1, that a description of 100 wt % of L-LDPE may not mean its pure state for making the snap fastener 11 but can contain a very little and general formulating ingredient.

According to the result of Table 1, the snap fastener 11 of the present invention can be preferably heat-welded with the bag body 22 at a low temperature of 143 degrees, which affects high productivity of the packaging bag with the snap fastener.

Since the manufactured packaging bag with the snap fastener 24 according to the present invention has an excellent high-temperature resistance at 99 degrees, the preferable open-and-close condition of the bag can be maintained and the appearance of the bag will not deteriorate. The user can expect wide application of the packaging bag with a fine shape of the packaging bag, because of the wide range of temperature when boiling and cooking.

2ND–6TH EXPERIMENTAL EXAMPLES

The 2nd–6th experimental examples in Table 1 have been conducted to confirm whether other snap fastener compounded with L-LDPE and LDPE in various composition ratios are useful.

Respective composition ratios in the 2nd–6th experimental examples are as follows; L-LDPE:LDPE=95 wt %:5 wt % in the experimental example 2, L-LDPE:LDPE=90 wt %:10 wt % in the experimental example 3, L-LDPE:LDPE=80 wt %:20 wt % in the experimental example 4, L-LDPE:LDPE=70 wt %:30 wt % in the experimental example 5, and L-LDPE:L-DPE=60 wt %:40 wt % in the experimental example 6.

First, each snap faster 11 in respective experimental examples is prepared as in the mentioned 1st experimental example. The test packaging bags with the thus prepared snap fasteners 24 can be prepared for each experimental example.

The hot-welding temperature is set at a temperature of 142 degrees in the 2nd experimental example and 140 degrees in the 3rd–6th experimental examples.

The shown results in Table 1 are obtained in the same way as the 1st experimental example. An observation of the test packaging bags used in the 2nd–6th experimental examples is that enough hot-weldability can be obtained at a temperature of from 140–142 degrees, which is lower than that in the 1st experimental example, and that the thermal properties when boiling reaches an extremely good temperature of 99 degrees. Furthermore, each of the test packaging bags used in the 2nd–6th experimental examples shows a good property of keeping its original shape as in the 1st experimental example.

7TH–11TH EXPERIMENTAL EXAMPLES

A packaging bag used in the 7th–11th experimental examples has a snap fastener 11 made of L-LDPE, having a different value of Melt Index (herein after referred to as MI).

The MI of L-LDPE is set as follows; 2 g/10 minutes in the 7th experimental example, 8 g/10 minutes in the 8th experimental example, 1 g/10 minutes in the 9th experimental example, 9 g/10 minutes in the 10th experimental example, and 15 g/10 minutes in the 11th experimental example.

First, the each snap fastener 11 in respective experimental examples is prepared as in the mentioned 1st experimental example. The test packaging bags with the thus prepared snap fasteners 24 can be prepared for each experimental example.

The hot-welding temperature is set at a temperature of 143 degrees in the 7nd–9th experimental examples and 142 degrees in both the 10th and 11th experimental examples. The shown results in Table 1 are obtained in the same way as the 1st experimental example.

An observation of the test packaging bags used in the 7th–11th experimental examples is that the thermal properties when boiling reaches an extremely good temperature of 99 degrees. Furthermore, each of the test packaging bags used in the 7th-8th experimental examples shows a good property of keeping its original shape as in the 1st experimental example so that the good open-and-close performance is not damaged.

The packaging bags in the 7th and 8th experimental examples do not show a perfect shape of the snap faster but such state will not be a problem in view of the actual performance of open-and-close.

12TH–14TH EXPERIMENTAL EXAMPLES

The 12th–14th experimental examples in Table 1 have been conducted to confirm whether other snap fastener compounded with L-LDPE and LDPE in various composition ratios are useful. Incidentally, the values of MI in the respective experimental examples are also varied.

Respective composition ratios in the 12th–14th experimental examples are as follows; L-LDPE:LDPE=95 wt %:5 wt % in experimental example 12, L-LDPE:LDPE-80 wt %:20 wt % in experimental example 13, and L-LDPE:LDPE=60 wt %:40 wt % in experimental example 14. The MI of L-LDPE is set as follows; 1 g/10 minutes in the 12th experimental example, 9 g/10 minutes in the 13th experimental example, and 15 g/10 minutes in the 14th experimental example.

First, each snap fastener 11 in respective experimental examples is prepared as in the mentioned 1st experimental example. The test packaging bags with the thus prepared snap fasteners 24 can be prepared for each experimental example.

The hot-welding temperature is set at a temperature of 142 degrees in the 12th experimental example and 140 degrees in both the 13th and 14th experimental examples.

The shown results in Table 1 are obtained in the same way as the 1st experimental example.

An observation of the test packaging bags used in the 12th-13th experimental examples is that the thermal properties when boiling reaches an extremely good temperature of 99 degrees. The test packaging bag used in the 14th experimental example has the thermal properties when boiling reaches at a temperature of 95 degrees. Furthermore, each of the packaging bags in the 12th–14th experimental examples does not show a perfect shape of the snap faster compared with that in the 2nd–6th experimental examples but such state will not be a problem in view of the actual performance of open-and-close.

15TH EXPERIMENTAL EXAMPLE

The snap fastener 11 used in this experimental example is made of L-LDPE and the thickness of the base film 23 forming the bag body 22 is varied.

The base film 23 consists of two layers, one being a nylon-6 layer having a 15 micrometers thickness and the other being a L-LDPE layer having a 100 micrometers thickness, which is thinner than the L-LDPE layer in the 1st experimental example by 20 micrometers.

First, the snap faster 11 is prepared as in the mentioned 1st experimental example. The test packaging bag with the thus prepared snap fastener 24 can be prepared.

The hot-welding temperature is set at a temperature of 141 degrees. The shown result in Table 1 is obtained in the same way as in the 1st experimental example.

An observation in this experimental example is that the heat-welding temperature is lower than that in the 1st experimental example by 2 degrees but other results are almost the same as in the 1st experimental example.

16TH–19TH EXPERIMENTAL EXAMPLES

The 16th–19th experimental examples are conducted to confirm whether the packaging bags compounded with other ingredients making the base film 23 are useful or not.

Respective ingredients of the base film 23 are as follows; the two layers with the 12-micrometer thickness polyethylene terephthalate (PET) layer and the 60-micrometer thickness LDPE layer in the 16th experimental example, the two layers with the 15-micrometer thickness nylon-6 layer and the 60-micrometer thickness LDPE layer in the 17th experimental example, the two layers with the 20-micrometer thickness biaxially oriented polypropylene finished with vinylidene chloride (KOP) and the 40-micrometer thickness LDPE layer in the 18th experimental example, and the three layers with the 15-micrometer thickness biaxially oriented nylon finished with vinylidene chloride (KON), 15-micrometer thickness LDPE and the 50-micrometer thickness ethylene-vinyl acetate copolymer (EVA) in the 19th experimental example. Incidentally, the respective inner layers of these base films 23 are the LDPE layer in each of the 16th–18th experimental examples and the EVA layer in the 19th experimental example.

First, each snap fastener 11 in the respective experimental examples is prepared as in the 1st experimental example. The test packaging bags with the thus prepared snap fasteners 24 can be prepared for each experimental example.

The hot-welding temperature is set at a temperature of 135 degrees in the 16th and 17th experimental examples, 133 degrees in the 18th experimental example, and 126 degrees in the 19th experimental example. The shown results in Table 1 are obtained in the same way as the 1st experimental example.

An observation in the 16th–19th experimental examples is that the hot-welding temperature is lower than in the 1st experimental example and the state of the snap fastener shape is fine as in the 1st experimental example but the thermal properties shows a temperature of 95 degrees, which is inferior to 99 degrees in the 1st experimental example by 4 degrees. ps 1ST–3RD CONTROL EXAMPLES First, each snap fastener in the respective control examples is prepared as in the mentioned experimental examples. The comparative packaging bags with the thus prepared snap fasteners can be made for the following control examples.

It will be mentioned, however, that the resin materials for the snap faster and a temperature of hot-welding in these control examples are varied.

The used material resins are as follows; the compound resin with 40 wt % L-LDPE and 60 wt % LDPE in the 1st control example, LDPE in the 2nd control example, and EVA in 3rd control example.

The respective set temperatures for hot-welding are 140 degrees in the 1st control example, 145 degrees in the 2nd control example, and 128 degrees in the 3rd control example.

The shown results in Table 1 are obtained in the same way as the 1st experimental example.

An observation in the 1st control example is that the sort of resin for the snap fastener is included in the scope of the present invention but does not have L-LDPE as a main ingredient, so that the hot-weldability at a low temperature is fine but the thermal properties when boiling is poor.

The snap fastener according to the 2nd control example does not made of the same resin in this invention, whereby the thermal properties when boiling is limited at a temperature of until 90 degrees, which is poor in view of the actual use.

The snap fastener according to the 3rd control example is not made of the same resin in this invention, so the hot-weldability at a low temperature is fine but the thermal properties when boiling is limited at a temperature of until 90 degrees, which is poor in view of the actual use.

4TH CONTROL EXAMPLE

The used resin material for the snap fastener 11 is PP in this control example, but preparation of the packaging bag with this snap fastener can not be obtained as the snap faster 11 does not hot-weld to the base film 23.

5TH AND 6TH CONTROL EXAMPLES

The snap fasteners used in these control examples are made of L-LDPE and the value of MI are varied.

First, the snap fastener 11 is prepared as in the mentioned 1st experimental example. The control packaging bag with the thus prepared snap fastener can be prepared.

As can be seen from Table 1, the MI value of L-LDPE is 16 g/10 minutes in the 5th control example and 25 g/10 minutes in the 6th control example.

The fine hot-welding state can be obtained in the control examples 5, 6 at a temperature of 143 degrees.

The shown result in Table 1 is obtained in the same way as in the 1st experimental example.

According to the 5th and 6th control examples, it is noted that the thermal properties when boiling the packaging bag can be obtained at a temperature of until 99 degrees as in the 1st experimental example, but the shape of the snap fastener is deformed so that the preferable performance of open-and-close is spoiled.

7TH AND 8TH CONTROL EXAMPLES

In these control examples, the compound rate of L-LDPE and LDPE is changed the 60 wt %:40 wt % and the MI values are also changed, respectively.

The MI value is 16 g/10 minutes in the 7th control example and 20 g/10 minutes in the 8th control example.

First, the snap fastener is prepared as in the mentioned 1st experimental example. The control packaging bag with the thus prepared snap fastener can be made.

The hot-welding can be conducted preferably at a temperature of 140 degrees in both control examples.

The shown result in Table 1 is obtained in the same way as in the 1st experimental example.

When reviewing these control examples 7 and 8, it is noted that the fine thermal properties when boiling can be obtained at a temperature of until 95 degrees which is a similar level to that in the 1st experimental example. However, the shape of the snap fastener is not kept in its original state, so that the performance of open-and-close is poor.

According to the above-mentioned experimental and control examples, the following results can be understood.

The snap fastener 11 made of L-LDPE or the composition of L-LDPE and LDPE can achieve a fine hot-welding condition at a lower temperature than that in the 2nd control example by from 2–5 degrees. The snap fastener compounded with independent L-LDPE or L-LDPE and LDPE at a composition ratio of 95 wt %–60 wt %:5 wt %–40 wt % can obtain the practical thermal properties at a temperature of at least 95 degrees. When the inner layer of the bag body uses L-LDPE, the thermal properties at a temperature of until 99 degrees can be expected. While, if the mixing ratio of L-LDPE and LDPE to produce the snap fastener is beyond the mentioned range, the thermal properties at a temperature of 95 degrees can not be expected as shown in the 1st control example.

When the value MI is set at from 1 g/10 minutes–15 g/10 minutes, the shape of the snap fastener can be kept in its original state, and particularly, from 2 g/10 minutes–8 g/10 minutes, the shape can be kept in an extremely good state. While, as in the 5th–8th control examples, when the value MI is beyond 15 g/10 minutes, the shape of the snap fastener can not be kept in an ideal state.

As shown in the 1st and 15th experimental examples, the thinner L-LDPE layer is effective to lower the hot-welding temperature.

As has been mentioned, the snap fastener according to the present invention is superior in the hot-welding to the bag body at the lower temperature than the conventional fastener and to the thermal properties. The packaging bag produced according to the present invention has fine thermal properties and maintains a good state of the performance of open-and-close.

TABLE 1

| | Composition of Snap Fastener (wt %) | Composition and Thickness (μm) of Bag Body Outer Layer/Inner Layer | * °C. | Thermal Properties °C. 90 | 95 | 99 | MI ** | State of Shape |
|---|---|---|---|---|---|---|---|---|
| Ex. Exam. 1 | L-LDPE(100) | NY6(15)/L-LDPE(120) | 143 | ○ | ○ | ○ | 6 | ◎ |
| Ex. Exam. 2 | L-LDPE(95) + LDPE(5) | " | 142 | ○ | ○ | ○ | 8 | ◎ |
| Ex. Exam. 3 | L-LDPE(90) + LDPE(10) | " | 140 | ○ | ○ | ○ | 5 | ◎ |
| Ex. Exam. 4 | L-LDPE(80) + LDPE(20) | " | 140 | ○ | ○ | ○ | 4 | ◎ |
| Ex. Exam. 5 | L-LDPE(70) + LDPE(30) | " | 140 | ○ | ○ | ○ | 8 | ◎ |
| Ex. Exam. 6 | L-LDPE(60) + LDPE(40) | " | 140 | ○ | ○ | ○ | 2 | ◎ |
| Ex. Exam. 7 | L-LDPE(100) | " | 143 | ○ | ○ | ○ | 2 | ◎ |
| Ex. Exam. 8 | " | " | 143 | ○ | ○ | ○ | 8 | ◎ |
| Ex. Exam. 9 | " | " | 143 | ○ | ○ | ○ | 1 | ○ |
| Ex. Exam. 10 | " | " | 142 | ○ | ○ | ○ | 9 | ○ |
| Ex. Exam. 11 | " | " | 142 | ○ | ○ | ○ | 15 | ○ |
| Ex. Exam. 12 | L-LDPE(95) + LDPE(5) | " | 142 | ○ | ○ | ○ | 1 | ○ |
| Ex. Exam. 13 | L-LDPE(80) + LDPE(20) | " | 140 | ○ | ○ | ○ | 9 | ○ |
| Ex. Exam. 14 | L-LDPE(60) + LDPE(40) | " | 140 | ○ | ○ | ○ | 15 | ○ |
| Ex. Exam. 15 | L-LDPE(100) | NY6(15)L-LDPE(100) | 141 | ○ | ○ | ○ | 6 | ◎ |
| Ex. Exam. 16 | " | PET(12)/LDPE(60) | 135 | ○ | ○ | x | 6 | ◎ |
| Ex. Exam. 17 | " | NY6(15)/LDPE(60) | 135 | ○ | ○ | x | 6 | ◎ |
| Ex. Exam. 18 | " | KOP(20)/LDPE(40) | 133 | ○ | ○ | x | 6 | ◎ |
| Ex. Exam. 19 | " | KON(15)/LDPE(15)/ EVA(50) | 126 | ○ | ○ | x | 6 | ◎ |
| Con. Exam. 1 | L-LDPE(40) + LDPE(60) | NY6(15)/LDPE(120) | 140 | ○ | x | x | 7 | ◎ |
| Con. Exam. 2 | LDPE(100) | " | 145 | ○ | x | x | 2 | ◎ |
| Con. Exam. 3 | EVA(100) | " | 128 | ○ | x | x | 3 | ◎ |
| Con. Exam. 4 | PP(100) | " | — | — | — | — | 7 | ◎ |
| Con. Exam. 5 | L-LDPE(100) | " | 143 | ○ | ○ | ○ | 16 | x |
| Con. Exam. 6 | L-LDPE(100) | " | 143 | ○ | ○ | ○ | 25 | x |
| Con. Exam. 7 | L-LDPE(60) + LDPE(40) | " | 140 | ○ | ○ | x | 16 | x |
| Con. Exam. 8 | L-LDPE(60) + LDPE(40) | " | 140 | ○ | ○ | x | 20 | x |

NOTE:
Ex. Exam. = Experimental Example
Con. Exam. = Control Example
* = Hot-welding temperature
** = g/10 Minutes

What is claimed is:

1. A snap fastener comprising a heat resistant welding portion to be welded to an object to be provided therewith, the welding portion of said snap fastener being made of a resin having a melt index of from 1–15 g/10 minutes and selected from the group consisting of linear low density polyethylene and a resin blend of linear low density polyethylene and low density polyethylene in a ratio of 95–60 wt. %:5–40 wt. %.

2. The snap fastener according to claim 1, wherein the welding portion of said snap fastener is made of the resin blend of linear low-density polyethylene and low-density polyethylene.

3. The snap fastener of claim 1, wherein said welding portion has a thickness of 80–220 microns.

4. The snap fastener of claim 1, wherein said welding portion has a thickness of 130–170 microns.

5. The snap fastener of claim 1, wherein said resin blend has a melt index of from 2–8 g/10 minutes.

6. A packaging bag capable of opening-and-closing repeatedly comprising: a bag body fabricated at three end portions thereof and a snap fastener having a heat resistant welding portion welded to one end portion other than the three end portions of said bag body, the welding portion of said snap fastener being made of a resin having a melt index of from 1–15 g/10 minutes and selected from the group consisting of linear low density polyethylene and a resin blend of linear low density polyethylene and low density polyethylene in a ratio of 95–60 wt. %:5–40 wt. %.

7. The packaging bag according to claim 6, wherein the welding portion of said snap fastener is made of the resin blend of linear low-density polyethylene and low-density polyethylene.

8. The packaging bag according to claim 6, wherein said bag body is adapted to have an inner side layer to which said snap fastener is welded, at least the inner side layer being made of a linear low-density polyethylene.

9. The packaging bag according to claim 8, wherein the inner side layer of said bag body is made of a low-density polyethylene and said bag body consists of plural laminated layers, of which an outer side layer adhered to the inner side layer is made of a nylon.

10. The packaging bag of claim 6, wherein said welding portion has a thickness of 80–220 microns.

11. The packaging bag of claim 6, wherein said welding portion has a thickness of 130–170 microns.

12. The packaging bag of claim 6, wherein said resin blend has a melt index of from 2–8 g/10 minutes.

* * * * *